US008800577B2

(12) United States Patent
Ma et al.

(10) Patent No.: US 8,800,577 B2
(45) Date of Patent: Aug. 12, 2014

(54) STRUCTURE OF UMBRELLA

(76) Inventors: Joen-Shen Ma, Taipei (TW); Yung Cheng Ma, Taipei (TW)

( * ) Notice: Subject to any disclaimer, the term of this patent is extended or adjusted under 35 U.S.C. 154(b) by 0 days.

(21) Appl. No.: 13/552,961

(22) Filed: Jul. 19, 2012

(65) Prior Publication Data

US 2014/0020725 A1 Jan. 23, 2014

(51) Int. Cl.

| | |
|---|---|
| ***A45B 25/02*** | (2006.01) |
| ***A45B 19/00*** | (2006.01) |
| ***D06F 57/04*** | (2006.01) |

(52) U.S. Cl.

CPC ..... *A45B 25/02* (2013.01); *D06F 57/04* (2013.01); *A45B 19/00* (2013.01)

USPC ..... 135/29; 135/15.1; 135/98; 211/197

(58) Field of Classification Search

CPC ..... A45B 25/06; A45B 25/10; A45B 19/00; E04H 15/28; E04H 15/46; E04H 15/48

USPC ..... 135/15.1, 28–31, 38, 42, 98, 135, 147, 135/159; 211/195–197; 403/170–173

See application file for complete search history.

(56) References Cited

U.S. PATENT DOCUMENTS

| | | | | |
|---|---|---|---|---|
| 2,802,579 | A * | 8/1957 | Hagar | 211/197 |
| 3,088,600 | A * | 5/1963 | Clensy | 211/166 |
| 4,550,840 | A * | 11/1985 | Van Deursen | 211/197 |
| 4,934,394 | A * | 6/1990 | Hermanson | 135/19.5 |
| 5,226,438 | A * | 7/1993 | Dubinsky | 135/33.4 |
| 5,449,075 | A * | 9/1995 | Meade et al. | 211/197 |
| 5,918,615 | A * | 7/1999 | Stuck, Sr. | 135/135 |
| 6,626,199 | B2 * | 9/2003 | Lin et al. | 135/28 |
| 6,702,129 | B1 * | 3/2004 | Harris | 211/196 |
| 7,481,235 | B2 * | 1/2009 | Prusmack | 135/135 |
| 7,802,580 | B2 * | 9/2010 | Hermanson et al. | 135/29 |

* cited by examiner

*Primary Examiner* — Winnie Yip

(74) *Attorney, Agent, or Firm* — Rosenberg, Klein & Lee

(57) ABSTRACT

An umbrella has a central shaft, a crown, a runner, a plurality of ribs, and a plurality of stretchers. The crown is a polygon each side of which includes a pivot pin mounted in a perpendicular direction to pivotally connect the upper end of a respective one of the ribs to the crown. The runner is a polygon and has a pivot pin mounted to each side in perpendicular direction to pivotally connect the lower end of a respective one of the stretchers to the runner. When the umbrella is closed, each of the ribs and the stretchers is collapsed in a tangential angle to set at one side of the central shaft and the runner and is not interfered with by the central shaft and the runner.

1 Claim, 5 Drawing Sheets

STRUCTURE OF UMBRELLA

BACKGROUND OF THE INVENTION

1. Field of the Invention

The present invention relates to an improved structure of umbrella, and in particular to an improved structure of umbrella, which comprises ribs and stretchers that, when the umbrella is closed, are collapsed in tangential angles to set at one side of the central shaft and the runner and are not interfered with by the central shaft and the runner so that the size of the umbrella when collapsed is reduced, the packaging material for the umbrella is reduced, and the cost is lowered down.

2. The Related Arts

A commonly known large-sized umbrella, such as a beach parasol, a garden parasol, and an advertising umbrella, has such a basic structure that is composed of a central shaft, a crown, a runner, a plurality of ribs, and a plurality of stretchers. The crown is fixed to a top end of the central shaft. The runner is fit over the central shaft to vertically slidable with respect thereto. Each of the ribs has an upper end pivoted to the crown. Each of the stretchers has an upper end pivoted to a middle portion of a respective one of the ribs and a lower end pivoted to the runner to control the vertical sliding motion of the runner along the central shaft for opening and closing a canopy.

In the conventional umbrella, if each rib of the umbrella is linear, then when the umbrella is opened, a polygonal canopy will show. If each rib is curved, then when the umbrella is open, a circular arc canopy can be formed.

The conventional umbrella that forms a circular arc canopy, although showing better aesthetics, yet suffers an apparent drawback. Since each of the ribs is curved, when the umbrella is closed, the end of each rib is blocked by the central shaft and the runner, making the middle portion of each curved rib significantly bulging out, so that the size of the umbrella is storage is increased, as shown in the attached FIG. 5. To increased storage size of the umbrella causes troubles to the user and also requires more package material and reduces the number of umbrella that can be accommodated in a unit accommodation space, so that the packaging and shipping costs of the umbrella are increased.

SUMMARY OF THE INVENTION

An object of the present invention is to provide an improved structure of umbrella, which overcomes the drawbacks of the conventional curved-rib umbrella that the storage size is increased and the costs of packaging and shipping operations are increased.

In other words, the improved structure of umbrella according to the present invention allows the ribs and stretchers to be collapsed to set at one side of the central shaft and the ribs and not to be blocked by the central shaft and the runner so that the size of collapsed umbrella is reduced and the packaging material used is reduced to thereby reduce the costs of packaging and shipping operations.

To achieve the above object, the present invention adopts the following technical solution.

The present invention provides an improved structure of umbrella, which comprises a central shaft, a crown, a runner, a plurality of ribs, and a plurality of stretchers.

The crown is fixed to a top end of the central shaft. The runner is fit over the central shaft to vertically slidable with respect thereto. Each of the ribs has an upper end pivoted to the crown. Each of the stretchers has an upper end pivoted to a middle portion of a respective one of the ribs and a lower end pivoted to the runner to control the vertical sliding motion of the runner along the central shaft for opening and closing a canopy.

Each of the ribs is curved so that when the umbrella is open, the umbrella as a whole forms a circular arc like canopy.

The crown is a polygon each side of which comprises a pivot pin mounted thereto in a substantially perpendicular direction to pivotally connect the upper end of a respective one of the ribs to the crown along a tangent.

Similar to the crown, the runner is a polygon each of which comprises a pivot pin mounted thereto in substantially perpendicular direction to pivotally connect the lower end of a respective one of the stretchers to the runner along a tangent.

According to the present invention, since each of the ribs has an upper end pivoted to the respective pivot pin outside the crown and each of the stretchers has a lower end pivoted to the respective pivot pin outside the runner, each of the ribs is set an angle that is tangential to an outer circumference of the central shaft. This is different from the conventional umbrella in which each rib, each stretcher, and the central shaft are set at positions in perpendicular directions. Thus, when the umbrella according to the present invention is closed, each of the ribs and each of the stretchers are collapsed to set at one side of the central shaft and the runner and are not interfered with by the central shaft and the runner, as shown in the attached FIG. 4, whereby the size of the umbrella when closed is reduced and thus the packaging material used is reduced and the costs of packaging and shipping operations are lowered.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
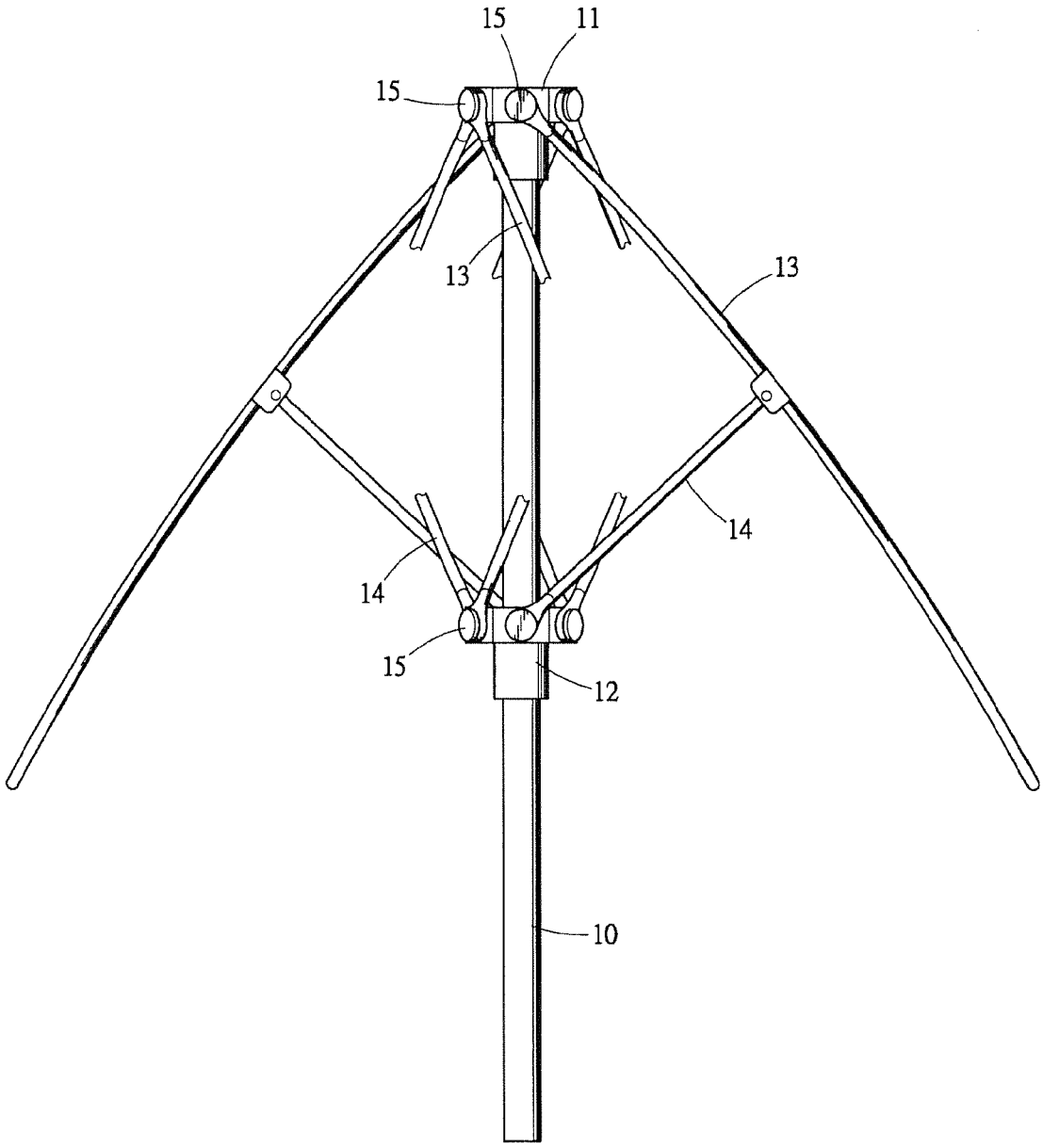
FIG. 1 is a side elevational view of an improved structure of umbrella according to a first embodiment of the present invention, in which some of ribs are broken.

FIG. 1 shows a side elevational view of an improved structure of umbrella according to a first embodiment of the present invention. In the drawing, some of ribs 13 are broken to show more details.

Figure 2:
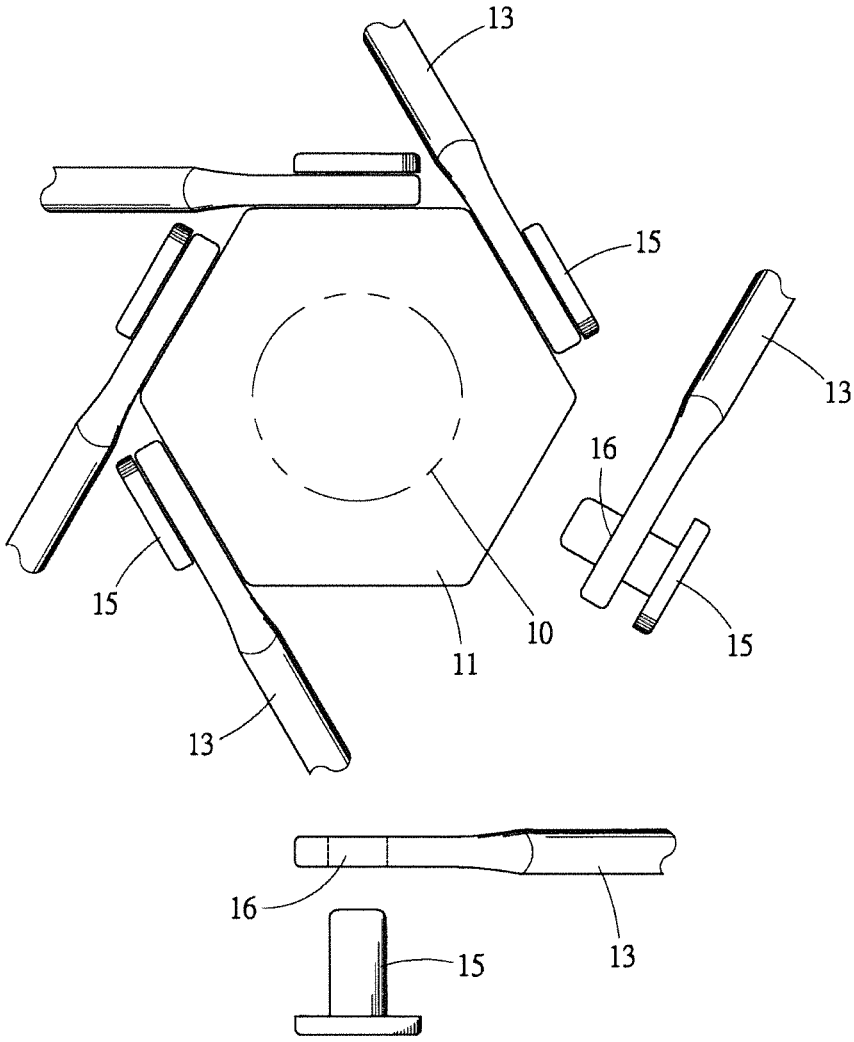
FIG. 2 is a top plan view of a crown and the ribs of FIG. 1, in which some of the ribs are removed from the crown.

FIG. 2 is a top plan view of a crown 11 and the ribs 13 of FIG. 1. In the drawing, some of the ribs 13 are removed from the crown 11.

As shown in FIGS. 1 and 2, the improved structure of umbrella according to the present invention comprises a central shaft 10, a crown 11, a runner 12, a plurality of ribs 13, and a plurality of stretchers 14, which are combined together to form the umbrella of the present invention.

As shown in FIG. 1, the crown 11 is fixed to a top end of the central shaft 10. The runner 12 is fit over the central shaft 10 and is vertically slidable along the central shaft 10. Each of the ribs 13 has an upper end pivoted to the crown 11. Each of the stretchers 14 has an upper end pivoted to a middle portion of a respective one of the ribs 13 and a lower end pivoted to the runner 12 to control the vertical sliding motion of the runner 12 along the central shaft 10 for opening and closing a canopy.

As shown in FIG. 1, each of the ribs 13 is curved so that when the umbrella is open, the umbrella as a whole forms a circular arc like canopy.

As shown in FIG. 2, the crown 11 is a polygon each side of which comprises a pivot pin 15 mounted thereto in a substantially perpendicular direction to pivotally connect the upper end of a respective one of the ribs 13 to the crown 11 along a tangent.

Further as shown in FIG. 1, similar to the crown 11, the runner 12 is a polygon each of which comprises a pivot pin mounted thereto in substantially perpendicular direction to pivotally connect the lower end of a respective one of the stretchers 14 to the runner 12 along a tangent.

Figure 4:
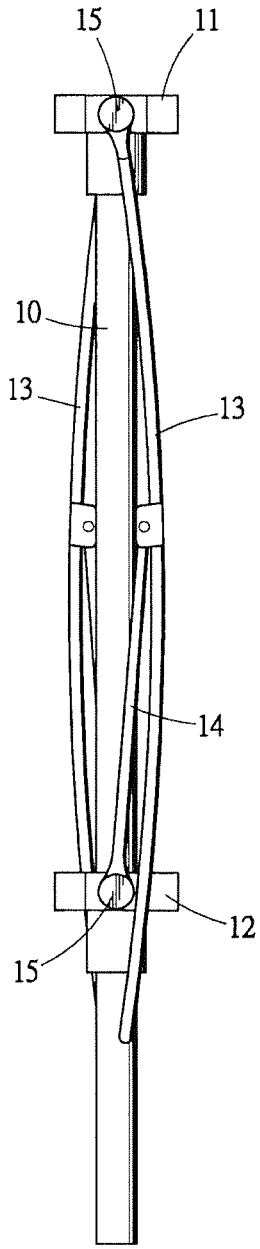
FIG. 4 is a schematic view showing the present invention in a collapsed condition.

The improved structure of umbrella according to the present invention is such that each of the ribs 13 has an upper end pivoted to the respective pivot pin 15 outside the crown 11 and each of the stretchers 14 has a lower end pivoted to the respective pivot pin 15 outside the runner 12. Each of the ribs 13 is set an angle that is tangential to an outer circumference of the central shaft 10. As shown in FIG. 2, when the umbrella is closed, each of the ribs 13 and each of the stretchers 14 are collapsed to set at one side of the central shaft 10 and the runner 12 and are not interfered with by the central shaft 10 and the runner 12 as shown in FIG. 4.

Figure 3:
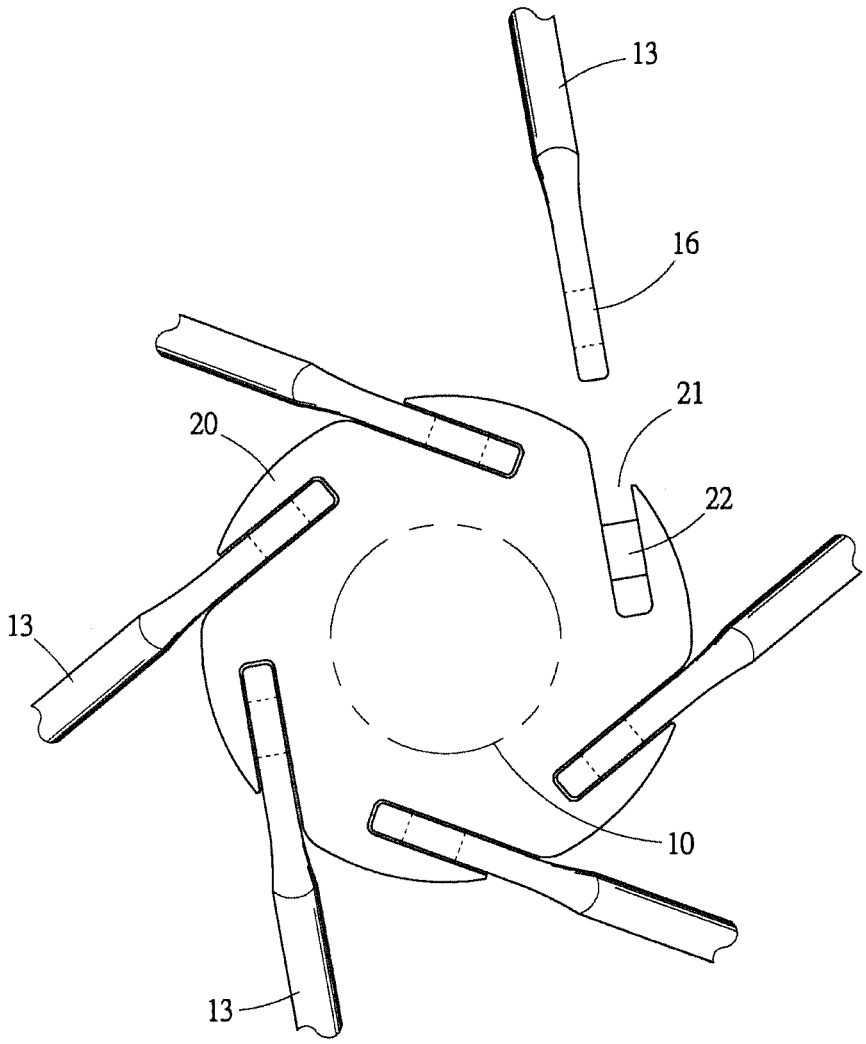
FIG. 3 is a top plan view of a crown according to a second embodiment of the present invention, in which one of ribs is shown removed from the crown.

FIG. 3 is a top plan view of a crown 20 according to a second embodiment of the present invention. In the drawing, one of ribs 13 is shown removed from the crown 20.

In the second embodiment of the present invention shown in FIG. 3, the crown 20 is a circle and a plurality of slanted slots 21 is defined in an outer circumference of the circle to each extend in a direction tangential thereto. Each of the slanted slots 21 comprises a pivot pin 22 fixed therein and each of the pivot pins 22 functions to pivotally connect an upper end of the respective one of the ribs 13 to the crown 20.

In the second embodiment of the present invention, the runner is shown in the drawings, yet it is to be noted here that the runner of the second embodiment may be circular, similar to the crown 20, and a plurality of slanted slots is defined in an outer circumference of the circle. Each of the slated slots comprises a pivot pin mounted therein and each of the pivot pins pivotally connects a lower end of the respective one of the stretchers 14 to the runner.

The second embodiment of the present invention is similar to the first embodiment in that when the umber is closed, each of the ribs and stretchers is collapsed to set at one side of the central shaft and the runner and are not interfered with by the central shaft and the runner. The function is exactly the same.

Figure 5:
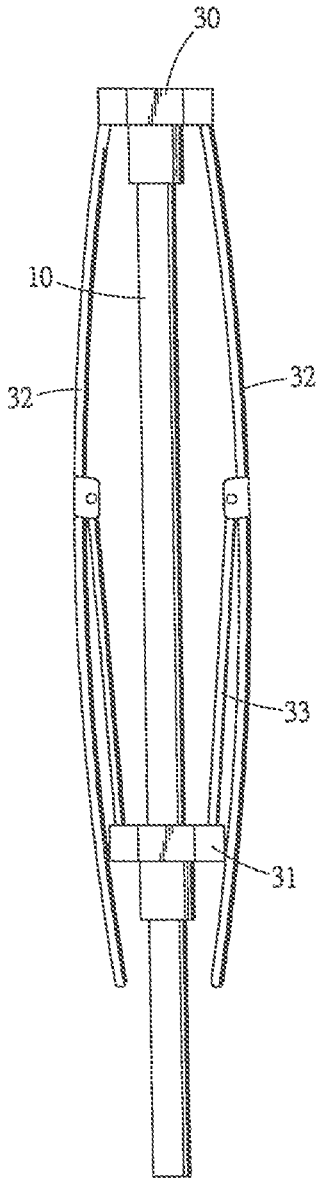
PRIOR ART Fig.-5
FIG. 5 is a schematic view showing a conventional umbrella in a collapsed condition.

For the improved structure of umbrella according to the present invention, the advantages are apparent: When the umbrella is closed, as shown in FIG. 4, each of the ribs 13 and each of the stretchers 14 are collapsed to set at one side of the central shaft 10 and the runner 12 and are not blocked by the central shaft 10 and the runner 12. A conventional umbrella, as shown in FIG. 5, is constructed such that each rib 32 is pivoted to the crown 30 at an angular position perpendicular to the central shaft and each stretcher 33 is pivoted to the runner 31 at an angular position perpendicular to the central shaft 10. When the umbrella is closed, the end of each rib 32 is blocked by the central shaft 10 and the runner 31 so that each curved rib 32 shows noticeable bulging at a middle portion, making the amount of space required for storing the umbrella increased.

When the improved structure of umbrella according to the present invention as shown in FIG. 4 is compared with the conventional umbrella of FIG. 5, although both use curved ribs, yet the present invention may reduce the size of the umbrella when it is collapsed. This reduces the quantity of packaging material used and thus reducing the costs of packaging and shipping operation, thereby effectively overcoming the shortcomings of the conventional umbrella and achieving the objects of the present invention discussed previously.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A structure of an umbrella, comprising a central shaft extending in a longitudinal direction, a crown, a runner, a plurality of ribs, and a plurality of stretchers, wherein the crown is fixed to a top end of the central shaft, the runner is fit over the central shaft to vertically slidable with respect thereto, each of the ribs has an upper end pivoted to the crown, each of the stretchers has an upper end pivoted to a middle portion of a respective one of the ribs and a lower end pivoted to the runner to control the vertical sliding motion of the runner along the central shaft for opening and closing a canopy, in which:

each of the ribs is curved so that when the umbrella is open, the umbrella as a whole forms a circular arc like canopy;

the crown being formed in the contour of a polygon having a plurality of planar sides; a plurality of pivot pins coupled to an upper end of each of said ribs and a respective side of said crown, said pivot pins extending in a direction substantially perpendicular to said longitudinal direction and a plane of said crown sides pivotally connecting the upper end of a respective one of the ribs to the crown along a tangent of each of said polygon sides; and the runner being formed in the contour of a polygon having a plurality, of runner planar sides; a plurality of runner pivot pins coupled to a lower end of each of a plurality and stretchers and a respective runner side, said runner pivot pins extending in a direction aubstantially perpendicular to said longitudinal direction and a plane of said runner sides to pivotally connecting the lower end of a respective one of the stretchers to the runner along a tangent of each of said runner polygon sides;

whereby when the umbrella is closed, each of the ribs and each of the stretchers are collapsed to set at one side of the central shaft and the runner and devoid of interference with by the central shaft and the runner.

* * * * *